United States Patent [19]

Stumpf

[11] 4,451,946

[45] Jun. 5, 1984

[54] POCKETED SPRING ASSEMBLY

[75] Inventor: Walter Stumpf, Dunwoody, Ga.

[73] Assignee: Simmons U.S.A. Corporation, Atlanta, Ga.

[21] Appl. No.: 323,574

[22] Filed: Nov. 20, 1981

[51] Int. Cl.[3] ..... A47C 27/09

[52] U.S. Cl. ..... 5/477; 5/475

[58] Field of Search ..... 5/475, 477, 478, 481

[56] References Cited

U.S. PATENT DOCUMENTS

| | | | |
|---|---|---|---|
| 1,284,384 | 11/1918 | Lewis | 5/477 |
| 1,465,766 | 8/1923 | Krakaver | 5/477 |
| 3,633,228 | 1/1972 | Zysman | 5/477 |
| 4,234,984 | 11/1980 | Stumpf | 5/477 |

*Primary Examiner*—Alexander Grosz
*Assistant Examiner*—Michael F. Trettel
*Attorney, Agent, or Firm*—Fitch, Even, Tabin & Flannery

[57] ABSTRACT

The pocketed upholstery springs of the disclosed assembly, made from strips of pocketed springs and intended for use in mattresses or cushions, are connected together in "square" array, i.e., each spring disposed in mutually perpendicular rows, by connecting the pocket sheeting of adjacent strips together between adjacent springs of each strip, the firmness of the assembly being increased by the nature of the interstrip connection, namely, an elongated connection centered at mid-height of the spring coils.

9 Claims, 7 Drawing Figures

POCKETED SPRING ASSEMBLY

This invention relates to assemblies of pocketed spring coils for use as the resilient cores of mattresses, cushions, and the like, which evolved from my further experimentation with the pocketed spring assembly disclosed and claimed in my U.S. Pat. No. 4,234,984, granted Nov. 25, 1980.

This invention is accordingly particularly concerned with the assembly of strips of pocketed spring coils in "square" array, i.e., with each spring coil disposed in two rows of springs at right angles to one another, and in which adjacent strips of pocketed springs are joined together by connecting the pocket sheeting of the two strips together between adjacent springs of the respective strips, and by staggering the interstrip connections from strip to strip as the strips of pocketed springs are assembled.

The advantages derived from this format are the elimination of the direct coil-to-coil connection previously employed when the square array of pocketed spring coils was preferred to the staggered or nested array which such springs tend to assume when assembled in strip form, thus preserving the individual coil action which is sacrificed by direct coil-to-coil connection, and seemingly eliminating the tendency, sometimes exhibited by nested assemblies of pocketed springs, to trap an individual coil or coils in the partially compressed condition when subjected to intense local load, as, for example, when kneeling upon the mattress.

As first developed and as disclosed in my U.S. Pat. No. 4,234,984, the interstrip connections of the sheeting material of the strips of springs were made as button-shaped thermal welds in the relatively slack reach of fabric between adjacent coils near the ends of the coils. In subsequent experimentation, however, I have discovered that by making the interstrip connections at mid-height of the spring coils, rather than at their ends, I can not only simplify the manufacturing procedure but, quite unexpectedly, I can control the firmness of the spring assembly by simply varying the length of the interstrip connection.

My invention will be understood from the following description made in conjunction with the attached drawings, of which:

Figure 2:
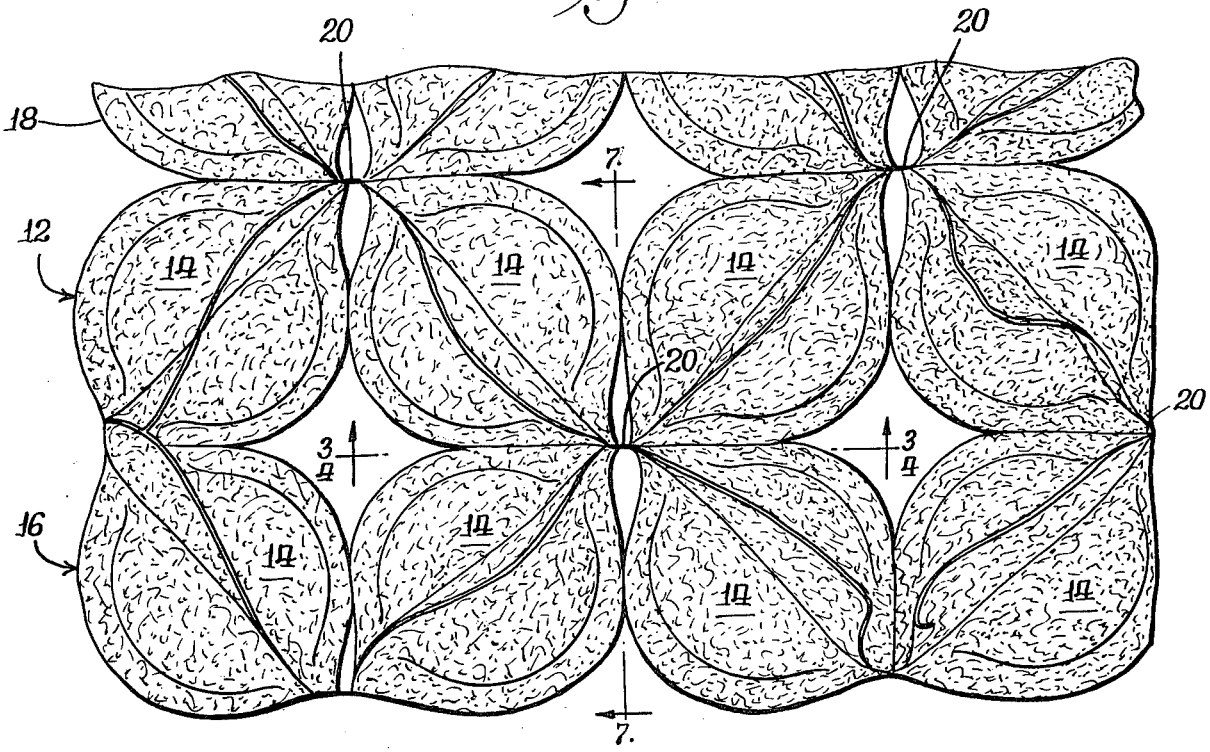
FIG. 2 is a fragmentary enlargement of one corner of an assembly such as that depicted in FIG. 1.
Figure 3:
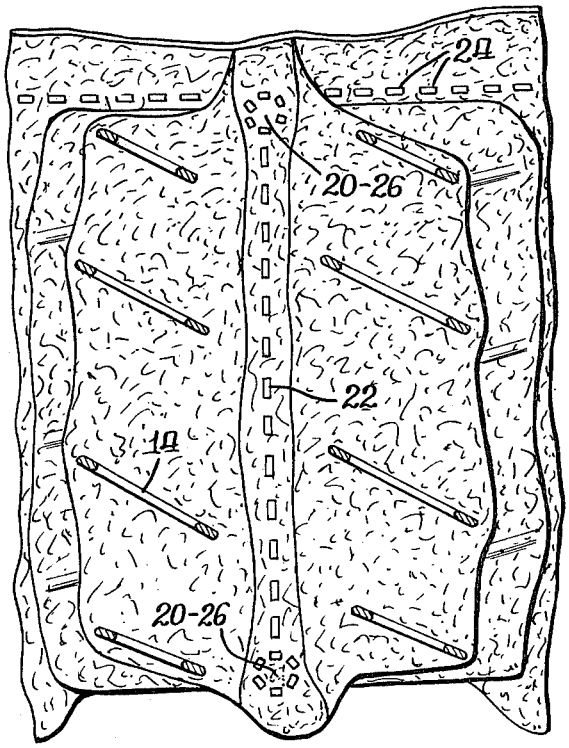
Figure 4:
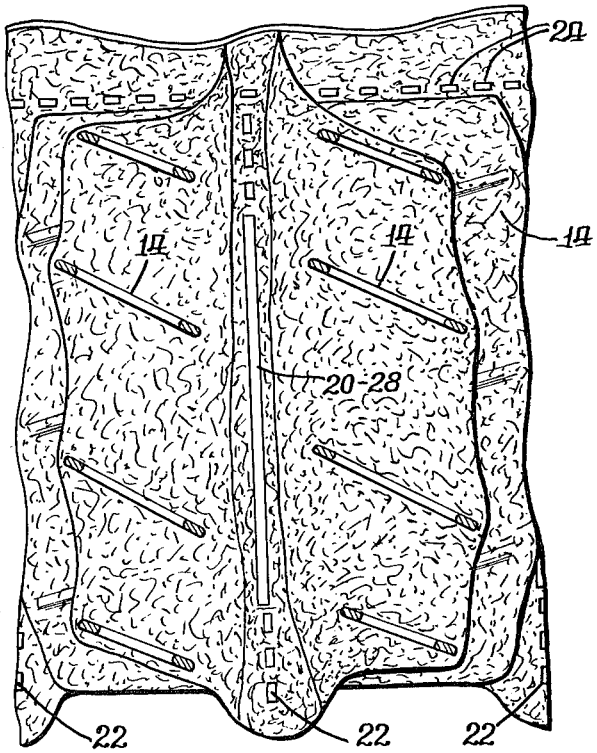
Figure 5:
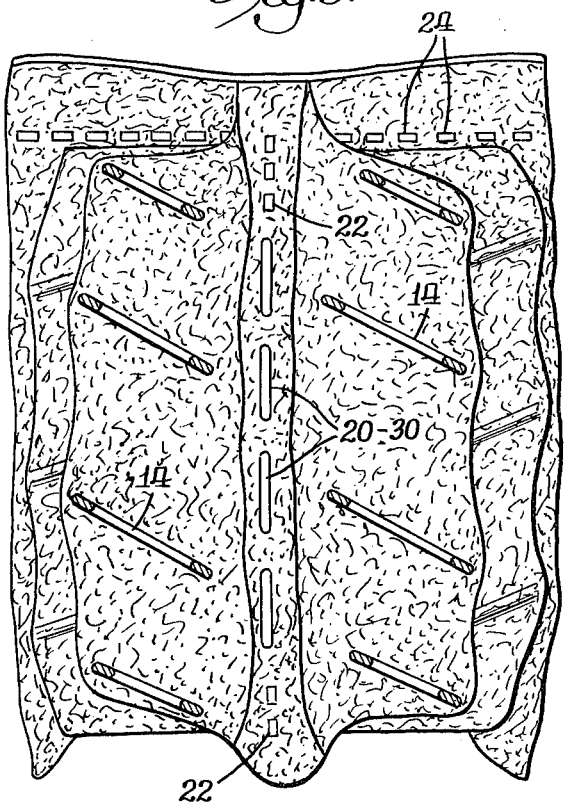
Figure 6:
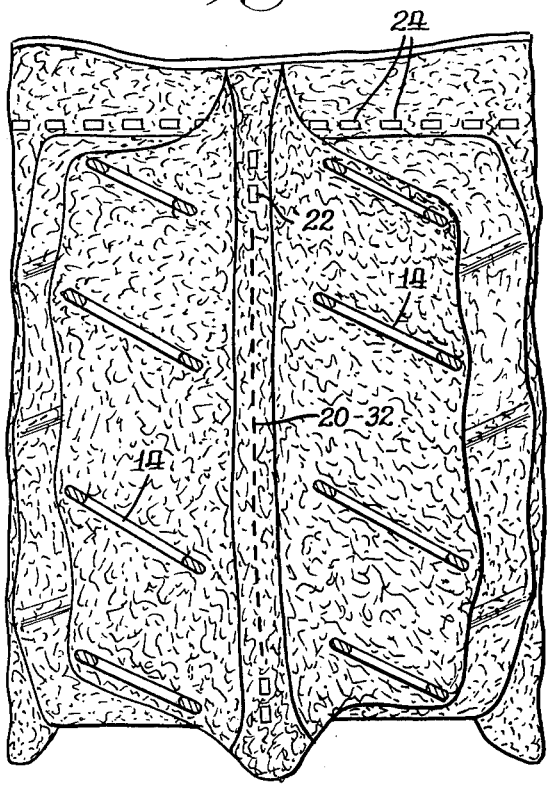
Figure 7:
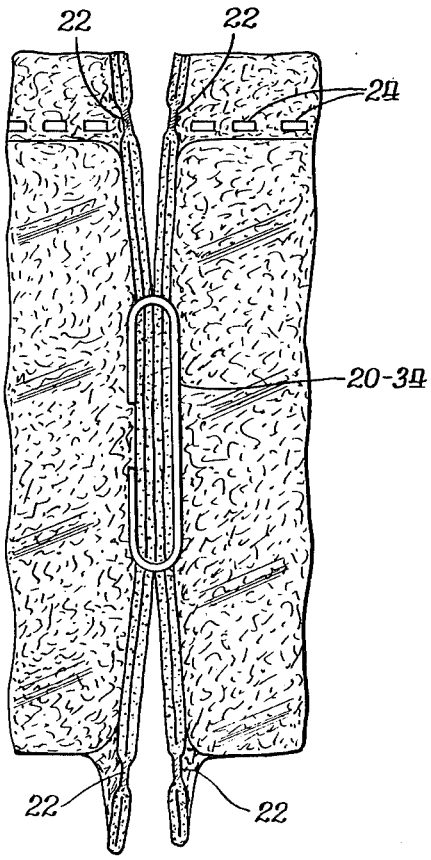

FIGS. 3 and 4 are fragmentary sectional elevations of the partial assembly shown in FIG. 2 taken along the line 3,4—3,4 of the latter, FIG. 3 showing the form of interstrip connection illustrated in my U.S. Pat. No. 4,234,984, FIG. 4 showing the improved interstrip connection of this invention, made as a single bar-shaped weld;

FIG. 5 is a fragmentary sectional elevation similar to FIGS. 3 and 4, but illustrating a modification of the form of interstrip connection of FIG. 4 in which the line of connection is intermittent, comprising a line of spaced welds;

FIG. 6 is a fragmentary sectional elevation similar to FIGS. 3 and 4, but showing the interstrip connection made by sewing; and FIG. 7 is a fragmentary sectional elevation show taken only the line 7—7 of FIG. 2 to a further modification in which the interstrip connection is made by stapling.

GENERAL DESCRIPTION

In the pocketed spring assembly 10 which provides the context or format for using the present invention, a given strip 12 of pocketed springs 14 is connected to each adjacent strip 16 and 18 by selectively connecting the sheet material of the adjacent spring strips together. Inasmuch as the overall pattern of the assembly tends to confuse the eye when viewed from a distance, reference should be made initially to the fragmentary enlargement of FIG. 2 from which it will be seen more readily that the connections 20 of a given strip of springs to its neighboring strip are made between a pair of successive springs 14 of each strip, and are alternated along any given strip, e.g., strip 12, so that the given strip is connected first to the neighboring strip on one side, e.g., strip 16, and then to the neighboring strip on the opposite side, e.g., strip 18, and so forth, along the entire given strip from one end or side of the assembly to the other.

As a result of the connection, the pair of coils of each strip immediately adjacent to an interstrip connection 20 are joined with an opposing pair in a configuration which, in plan, resembles a four-leaf clover, each spring pocket being rotated approximately one-eighth turn away from the longitudinal axis of its own strip.

Whereas the interstrip connections 20 of the construction shown in my prior U.S. Pat. No. 4,234,984, shown in FIG. 3 hereof, were conveniently made as two button shaped connections 20–26 near each face of the spring assembly, in the slack reach of fabric resulting from the preferred barrel shape of the spring coils used, I have found an unexpected benefit in making the interstrip connections 20 at mid-height of the coils in the form preferably of a single, continuous elongated strip connection 20–28, centered on the mid-height of the coil, as shown in FIG. 4.

Such an assembly, other things being equal, can be made firmer than the assembly of my earlier patent (FIG. 3) in which the interstrip connections are made near the ends of the springs. I have found, moreover, that by varying the length, or height, of the mid-height interstrip connection 20–28, I can change the firmness or load-carry of the assembly with no change whatever in the pocketed springs from which the assembly is made.

DETAILED DESCRIPTION

The strips of pocketed coils 14 chosen to illustrate the invention are those produced commercially by the assignee of this invention, and comprise a folded two-ply strip of non-woven fabric of thermoplastic fibers in which the spring pockets are defined between the plies by transverse lines 22 of discrete thermal welds of the plies to one another, and in which the pockets formed in the two-ply strip are closed by a longitudinal seam 24 of similar thermal welds to confine the springs in the pockets. When the springs are permitted to expand after being confined within the pockets, they impose their shapes upon the confining pocket walls in the mid-height zone of the pockets, and produce a ruffle in the flaps of the closing seam, and at the opposite non-seamed end of the spring pocket as well, as the separation of the plies by the expansion of the included spring foreshortens the cloth strip.

In the presently preferred form of the present invention (FIG. 4), as well as in the form of my prior U.S. Pat. No. 4,234,984 (FIG. 3), the connection 20 between adjacent spring strips is likewise made by thermally welding the four layers of pocket sheeting of the two adjacent spring strips together. Each such connection 20–28 is a weld in strip form, centered, as shown in FIG. 4, on the mid-height of the expanded coil and extending toward the opposite faces of the assembly. While the fabric preferred for the pocket material is one which is favorable to the employment of welding as the particular fabric-connecting technique, the illustrated assembly format is not so limited. The two adjacent strips could be connected together, for example, by a line of adhesive. The assembly can also be executed in other kinds of textile fabrics, or in other appropriate sheet materials, by other joining techniques, whether by stitching or pre-stitching or by the use of appropriate metal fasteners or the like, as illustrated by the modifications later described.

As pointed out in the foregoing general description, the making of the connections 20 draws the two flanking coils of each strip into mutual engagement at mid-height of the group of four coils surrounding each connection, locking them into a four-leaf clover pattern with the closing seams of the pocket strips radiating from the connection 20 as cross-diagonals.

The assembly of springs by connecting the strips together, rather than by connecting the springs, as such, to one another, permits each spring to maintain a considerable degree of individual action before requiring the depression of its neighbors in the clover-leaf array, and yet, beyond that point, as in areas of concentrated load under the proportionately heavier parts of the body, or when the spring assembly is highly loaded as by bearing the weight of the occupant in sitting or kneeling position, the clover-leaf connection of four springs together in a closely-knit group associates them cooperatively so that each can assist the other to regain the full unloaded height permitted by the confining pocket when the concentrated load is subsequently removed.

Figure 1:
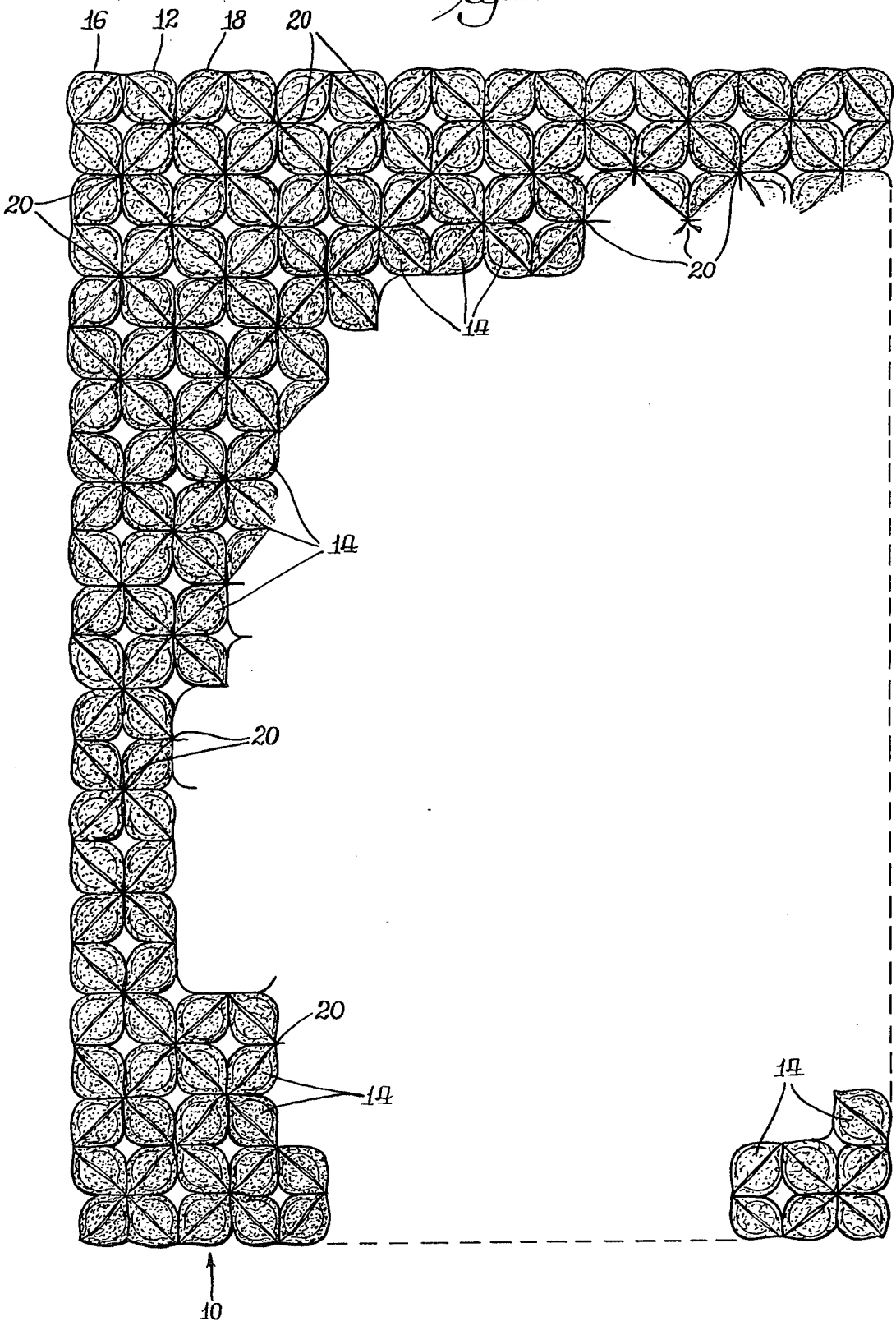
FIG. 1 is a plan view of one face of a rectangular pocketed spring assembly for a mattress, or cushion, or the like, with the springs disposed in non-nested, square array, i.e., with each spring occupying simultaneously a position in two mutually perpendicular spring rows.

In the illustrated assembly the constituent strips of springs are assembled as consecutive rows of equal length which may run from top to bottom, or from side to side, as seen in FIG. 1, that particular form of layup being convenient to the assembly of a mattress-size construction in a vertical or near vertical plane, particularly when, as illustrated, the assembly is made from a single continuous strip of springs laid upon itself row by row in serpentine fashion.

Moreover, in the preferred format, the connection of each given strip, such as strip 12, to any adjacent strip, such as strip 18, is made at two-coil intervals. Its connections to the opposite adjacent strip, e.g., strip 16, are also made at two-coil intervals, with the interstrip connections staggered from strip to strip. In this arrangement, as will be noted more especially from FIG. 1, every interior coil of the assembly, considered individually, is simultaneously a constituent part of two diagonally-connected cloverleafs, and thus enjoys a direct cooperative association with six other springs. The two-coil interval between connections of springs strips in serpentine lay-up produces a construction which is uniform of configuration along all four edges of the assembly, all coils in each edge being in a straight line. Moreover, the reverse bending of each strip between successive connections to opposite adjacent strips tensions the pocket material so that, as successive strips are joined to their assembled predecessors, a taut shape-retaining construction is achieved having uniform square corners at the junctures of straight, smooth and uniform edges with inherent diagonal bracing to maintain its trim shape and manufactured dimensions, with or without the addition of border wires.

The mid-height interconnections 20–28 of the adjacent strips to each other in accordance with the invention increases the lateral tension of the pocket material to a greater degree than connections 20–26 made near the ends of the coils, as in the earlier form of my invention disclosed in my U.S. Pat. No. 4,234,984 (FIG. 3), and result in a tighter confinement of each spring coil in its respective pocket. I believe this to be one of the factors which provides that added measure of control which I have found can be employed to increase the firmness, or load-carry, of the spring assembly simply by increasing the length of the mid-height interstrip connection 20–28.

When the usual pocketed spring is compressed, little or no relative movement of the coil convolutions relative to the contacting pocket material is evident, the pocket sheeting simply folding between the convolutions like a bellows. However, it is equally readily observable that the compression of spring coils increases the radius of the individual convolutions. It seems logical, therefore, upon reflection, that when the lateral or hoop tension of the confining pocket is increased by the making of the successive interstrip connections, the pocket exerts a greater resistance to the radial expansion of the spring coil, and thereby reinforces the spring. By increasing the length of the interstrip connection between adjacent strips of pocketed springs, the zone of increased pocket tension is broadened over a greater height of the spring to restrain a larger vertical portion of each spring, thereby further firming the assembly.

The observed effect is also attributable in part to another phenomenon of spring behavior. It is known that if a spring is permitted a degree of movement which will permit bowing of its axis when not loaded squarely, the spring is less effective, i.e., its load-carry is reduced. In normal service in mattresses, the conformation of the spring assembly to the contours of the human body exerts such a canting or bowing force on some of the springs involved, notwithstanding that the mattress is supported on a plane surface. In the disclosed assembly, i.e., with the adjacent strips of springs joined at mid-height of the spring coils as in FIG. 4, the individual coils are mutually reinforcing against bowing, the more so as the length of the interstrip connection is increased.

To illustrate these observed effects on a comparative basis, I prepared three assemblies from nominally identical, run-of-the-machine strips of spring coils, each comprising 38½inches of 15½gage wire, and having a coil height of 5 inches and coil diameter of 2½inches in the pockets. The pocket sheeting was the present standard sheeting for the Beautyrest Mattress manufactured by the assignee of this invention, viz., a non-woven polypropylene sheeting manufactured by Phillips Fibers Corporation and identified by the trademark Duon. In one of the assemblies, I used the button-weld interstrip connection 20–26 of FIG. 3, disclosed in my prior U.S. Pat. No. 4,234,984. In another of the assemblies, I used the continuous strip weld 20–28, illustrated in FIG. 4 hereof with the length of the weld being two inches centered at mid-height of the coils. In the third assembly, I increased the length of the bar or strip weld 20–28 between adjacent strips to a length of four inches.

A distinct difference in the firmness of the assemblies is readily discernible to hand feel, the assembly in accordance with the disclosure of my prior patent being the softest, the assembly made with the continuous bar-weld of two inches at mid-height being detectably firmer, and the assembly made with the four-inch continuous seals centered at mid-height being decidedly firmer than either of the other two.

As it was believed by some who were privy to my investigation that the observed result, i.e., the firmer response of the assembly with the longer interstrip connection, might be due merely to the earlier supportive response of surrounding springs as any one local area were compressed, I modified my welding apparatus to interrupt the four-inch long seal with a gap of nearly three-inches, i.e., so that the connection between strips consisted of two aligned bar-shaped welds, each 9/16 inches long, but separated by a distance of $2\frac{7}{8}$inches so as to span a total of four inches.

The resulting assembly was softer than that with the continuous four-inch connection, having a firmness comparable, as it happens, to that of the assembly of my prior patent, here illustrated in FIG. 3. This experiment confirmed to my mind the significance of the mid-height restraint of the individual spring coils. At the same time, however, it led me to the conclusion that an intermittent interstrip connection 20–30, as illustrated in FIG. 5, and which provided the desired mid-height restraint, notwithstanding its interruptions, would be quite feasible.

In the modification of FIG. 6, the interstrip connection 20–32 is made by a line of stitching (the pocket-defining welds 22 being largely omitted from FIG. 6 so as not to obscure the line of stitching). The stitching may be done either by pre-sewing before the springs are expanded in their pockets or possibly before the springs are inserted into the pockets and the latter closed. While not usually thought of as an interrupted or intermittent connection, a line of stitching, considered incrementally, is exactly that.

The modification of FIG. 7 employs stapling the medium for connecting adjacent strips together. The single, centered, staple connection 20–34 in the illustrated embodiment may be limited in size, as a practical matter, so that if a longer line of connection 20–34 of that kind be desired, two or more aligned staples may be preferred to provide articulation in the interstrip connection to avoid damage to the assembly or discomfort to the user.

It is apparent that my newly discovered form of interstrip connection of the strips of spring coils assembled in the format of my prior U.S. Pat. No. 4,234,984 will permit the manufacture of mattresses in varying degree of firmness without requiring any change of the gage of the spring wire or of spring dimension or other design parameters, but which will provide firmness control by simply varying the length of an interstrip connection.

This can be achieved in the manufacturing process with a fair degree of convenience where the assembly technique is that of thermal welding, but the concept is obviously valid irrespective of the particular manner of effecting a continuous or substantially continuous interstrip connection centered on the mid height of the spring coils.

The features of my invention believed new and patentable are set forth in the appended claims.

What is claimed is:

1. An improved pocketed coil spring assembly of the type having at least one continuous strip of coil springs arrayed in multiple rows of springs, said coils each being encased in individual adjacent pockets formed between layers of pocketing sheet material by joining together said layers between adjacent pockets, wherein the improvement comprises the joining together of adjacent rows of springs by joining the pocket sheet material of said strips together between said pockets at intervals along said adjacent strips by a line of connection substantially parallel to the axis of the coils, the length of said line of connection adapted to be of a length sufficient to achieve a desired firmness in the assembly.

2. The assembly of claim 1 wherein said lines of connection are intermittent.

3. The assembly of claims 1 and 2 wherein said pocketing sheet material is thermally weldable and wherein the lines of connection are made by thermally fusing the sheet material.

4. The assembly of claims 1 and 2 wherein said lines of connection are made by stitching the layers of sheet material together.

5. An improved assembly of pocketed wire coil springs for mattresses, cushions, or the like, of the type comprising a plurality of touching strips of integrally-connected springs confined in pockets defined between layers of elongated sheet material, the springs of said assembly being disposed in rectangular array in which any given pocketed spring is positioned in two rows at right angles to each other and in touching contact with the adjacent pocketed springs of said two rows, and each said given spring is one of such a strip of springs constituting one of said two rows of springs, adjacent strips of springs being joined together by joining the pocket material of said adjacent strips, at intervals of at least two springs along each said strip, with said interstrip junctures between successive adjacent strips being staggered from strip to strip, the improvement wherein each juncture of said adjacent strips to one another is a line of connection of the pocket material of one strip to the pocket material of the adjacent strip, said line being perpendicular to the load bearing faces of the assembly, being centered on the mid-height of the pockets, and serving to increase the lateral tension of said pocket material in the mid-height zone of said pocket sufficiently to restrict the radial expansion of said springs in said zone when said springs are compressed axially, and to aid in maintaining the axes of said compressed springs straight and perpendicular to the surface on which such mattress or the like is supported.

6. The improvement of claim 5 wherein said lines of connection are intermittent.

7. The improvement of claim 6 wherein each line of connection is defined by a plurality of discrete and uniformly spaced connections.

8. The improvement of each of claims 5 to 7 in which the pocket material is thermally weldable and the interstrip junctures are made by thermally fusing the pocket material.

9. The method of increasing the firmness of the spring assembly of claim 5 which comprises increasing the length of said line of connection so as to increase the depth of said mid-height zone of the spring pockets.

* * * * *

UNITED STATES PATENT AND TRADEMARK OFFICE

CERTIFICATE OF CORRECTION

PATENT NO. : 4,451,946

DATED : June 5, 1984

INVENTOR(S) : Walter Stumpf

It is certified that error appears in the above-identified patent and that said Letters Patent is hereby corrected as shown below:

Column 2, line 1, delete "show";

line 2, change "only" to --along--;

line 2, after "to" insert --show--.

Column 5, line 45, after "stapling" insert --as--.

Signed and Sealed this

Second Day of October 1984

[SEAL]

*Attest:*

GERALD J. MOSSINGHOFF

*Attesting Officer*

*Commissioner of Patents and Trademarks*